US008230695B2

(12) United States Patent
Kim et al.

(10) Patent No.: US 8,230,695 B2
(45) Date of Patent: Jul. 31, 2012

(54) AIR CONDITIONER

(75) Inventors: Jung-Hoon Kim, Seoul (KR); Dong-Soo Moon, Seoul (KR); Ki-Won Seo, Anyang-si (KR); Deok Huh, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 924 days.

(21) Appl. No.: 12/301,485

(22) PCT Filed: May 18, 2007

(86) PCT No.: PCT/KR2007/002442

§ 371 (c)(1),
(2), (4) Date: Nov. 19, 2008

(87) PCT Pub. No.: WO2007/136203

PCT Pub. Date: Nov. 29, 2007

(65) Prior Publication Data

US 2010/0132393 A1 Jun. 3, 2010

(30) Foreign Application Priority Data

May 20, 2006 (KR) ..... 10-2006-0045428

(51) Int. Cl.
*F25D 19/00* (2006.01)

(52) U.S. Cl. ..... 62/296; 62/419

(58) Field of Classification Search ..... 62/296, 62/419, 426, 515
See application file for complete search history.

(56) References Cited

U.S. PATENT DOCUMENTS 4,898,003 A * 2/1990 Ichikawa et al. ..... 62/244
5,673,747 A * 10/1997 Kousaka et al. ..... 165/41
6,086,324 A * 7/2000 Ikeda et al. ..... 415/53.1

FOREIGN PATENT DOCUMENTS

| | | | |
|---|---|---|---|
| DE | 39 14242 | A1 | 10/1990 |
| JP | 08-121396 | | 5/1996 |
| JP | 11-182884 | | 7/1999 |
| JP | 11-304178 | | 11/1999 |
| KR | 10-1999-00086341 | | 12/1999 |
| WO | WO 02/103250 | A2 | 12/2002 |
| WO | WO 2005/098319 | A1 | 10/2005 |

OTHER PUBLICATIONS

European Search Report dated Feb. 17, 2011 issued in Application No. 07 74 6590.
International PCT Search Report dated Aug. 20, 2007.

* cited by examiner

*Primary Examiner* — Melvin Jones
(74) *Attorney, Agent, or Firm* — KED & Associates LLP

(57) ABSTRACT

Provided is an indoor unit of an air conditioner. The structures of the indoor unit, such as the relationship between an inlet and an outlet, the shape of a rear guide, and the relationship between the outlet and a vane, are improved. Therefore, the airflow of the indoor unit is stable, and the noise level of the indoor unit is low.

19 Claims, 3 Drawing Sheets

[Fig. 1]
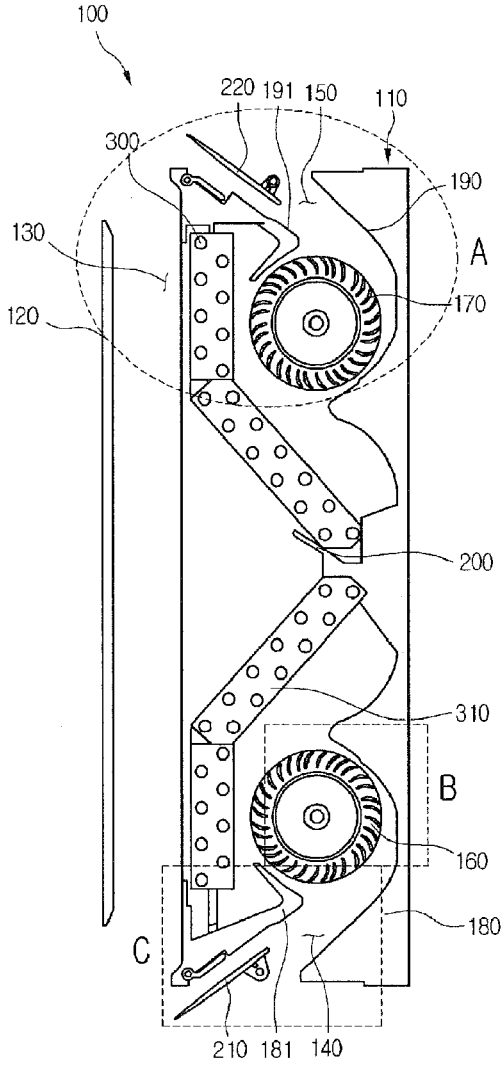
[Fig. 2]
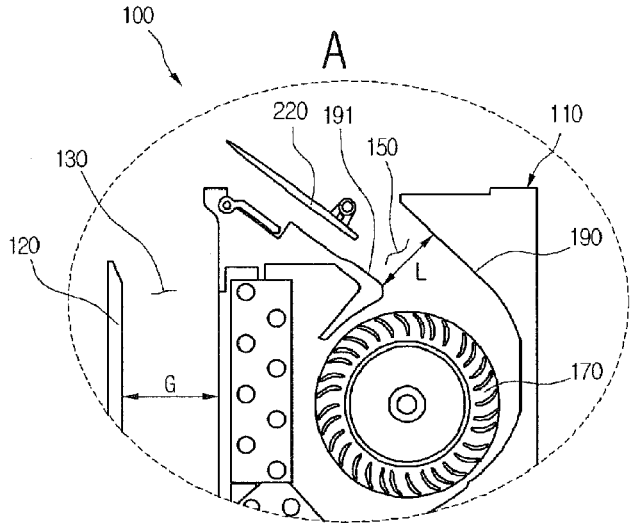

[Fig. 3]
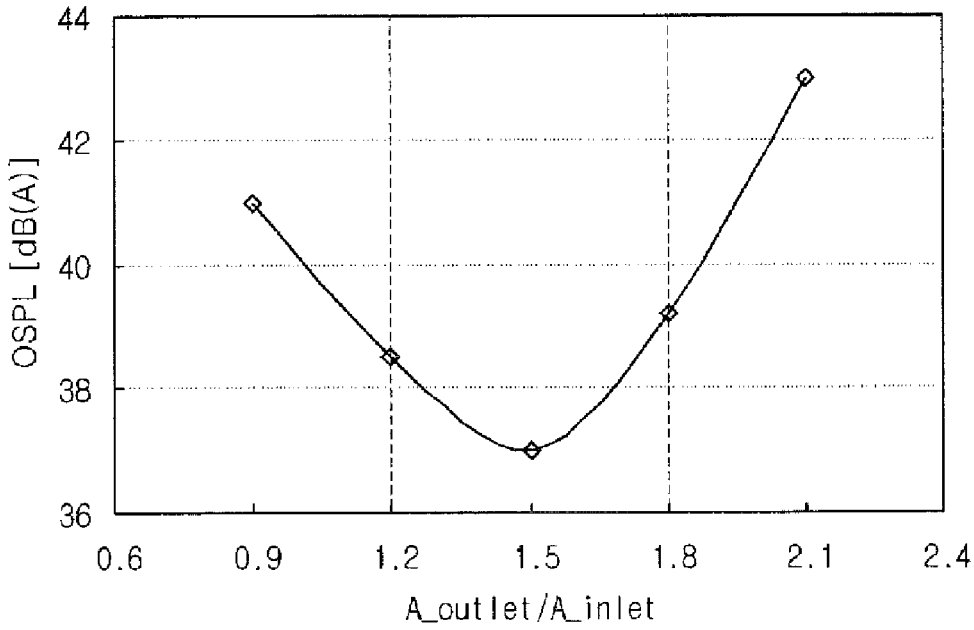
[Fig. 4]
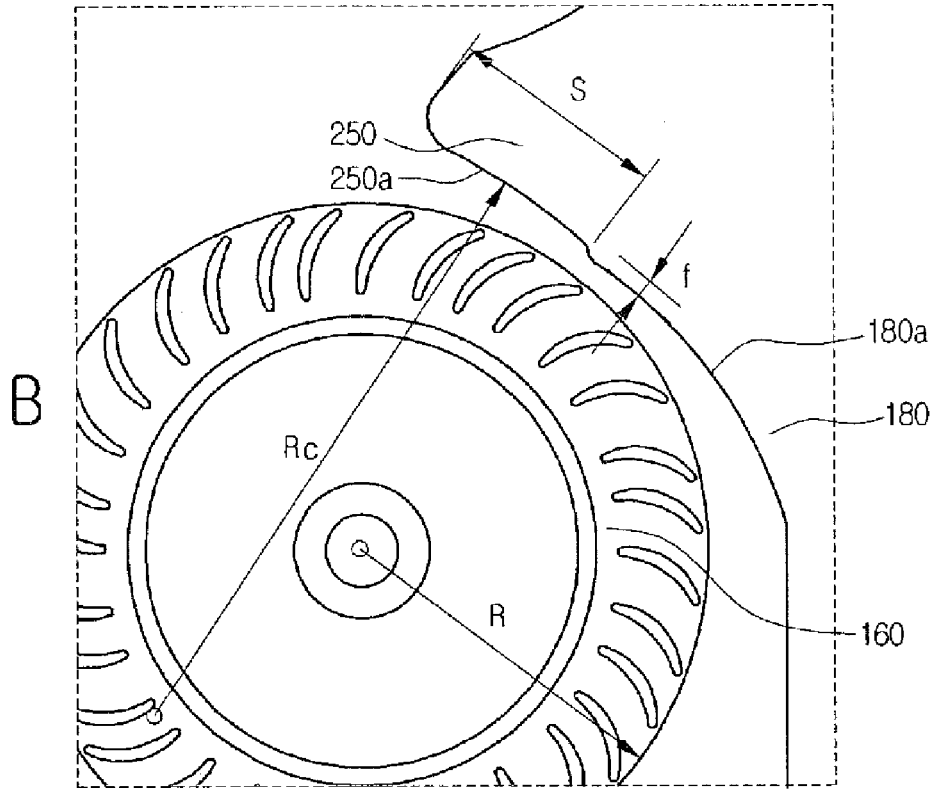

[Fig. 5]
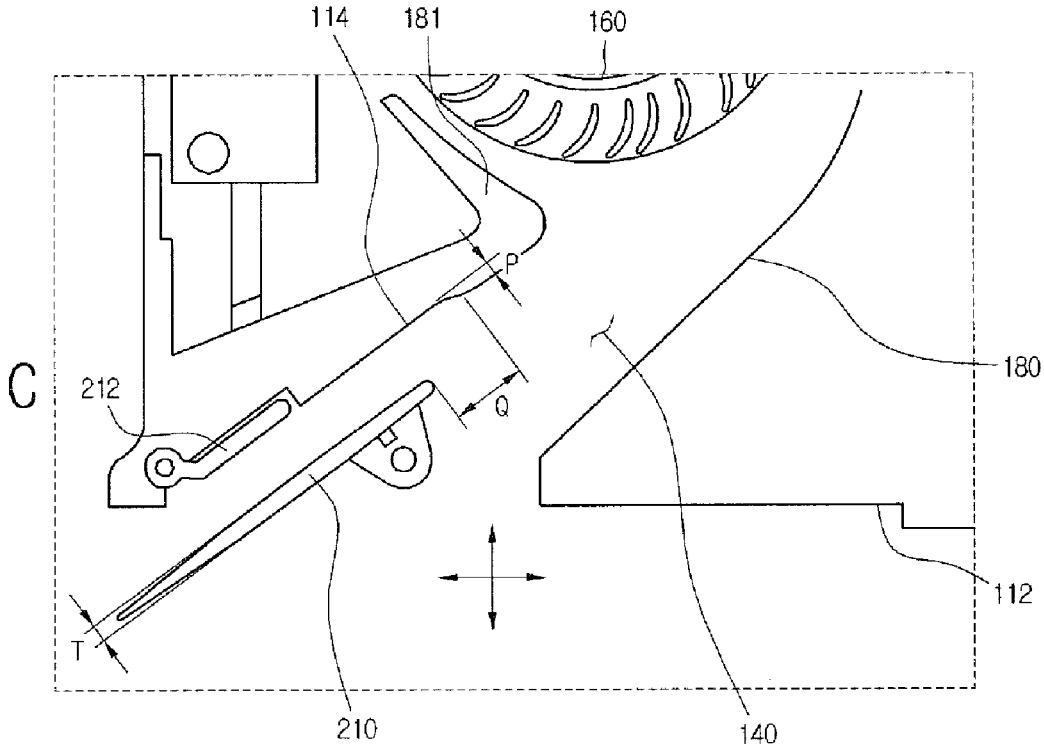

AIR CONDITIONER

TECHNICAL FIELD

The present disclosure relates to air conditioner, and more particularly, to an indoor unit of an air conditioner that produces less noise.

BACKGROUND ART

Air conditioners are used to control air of an indoor area depending on the purpose of the indoor area. For example, air conditioners are used to cool indoor air in summer and heat indoor air in winter. Furthermore, the air conditioners are used to control the humidity of indoor air and clean indoor air.

Such air conditioners can be classified into a split air conditioner and a one-body air conditioner. In the split air conditioner, an indoor unit and an outdoor unit are separated. In the one-body air conditioner, an indoor unit and an outdoor unit are combined in one piece.

Meanwhile, an indoor unit of an air conditioner includes an indoor fan for blowing air and an indoor heat exchanger for heat exchange between air and a refrigerant. The indoor unit can further include an air guide for guiding air blown by the indoor fan.

The indoor unit further includes an inlet in one side and an outlet in the other side. Air is introduced into the indoor unit through the inlet. The air is discharged from the indoor unit through the outlet after changing heat with a refrigerant at the indoor heat exchanger. The positions of the inlet and outlet of the indoor unit can be varied.

Generally, a vane is disposed at the outlet of the indoor unit to control the direction and amount of air discharged from the indoor unit through the outlet.

The structures of the indoor unit, such as the relationship between areas of the inlet and the outlet, the shape of the air guide, and the relationship between the outlet and the vane, are closely related to noises of the indoor unit.

Therefore, there is a need for an indoor unit having optimized structures for reducing noises.

DISCLOSURE OF INVENTION

Technical Problem

Embodiments provide an indoor unit of an air conditioner, the indoor unit having optimized inlet and outlet structures for reducing noises.

Embodiments also provide an indoor unit of an air conditioner, the indoor unit having an optimized air guide structure for reducing noises.

Embodiments also provide an indoor unit of an air conditioner, the indoor unit having optimized outlet and vane structures for reducing noises.

Technical Solution

In one embodiment, there is provided an indoor unit of an air conditioner, the indoor unit having a cross-flow fan, and a stabilizer and a rear guide for guiding an air stream generated by the cross-flow fan, characterized in that a ratio of an inlet area A(in) to an outlet area A(out) of the indoor unit ranges from 1.2 to 1.8.

In another embodiment, there is provided an indoor unit of an air conditioner, the indoor unit having a cross-flow fan, and a stabilizer and a rear guide for guiding an air stream generated by the cross-flow fan, characterized in that the rear guide comprises a noise reducing portion extending from a leading end of the rear guide for reducing noises caused by the air stream generated by the cross-flow fan.

In a further another embodiment, there is provided an indoor unit of an air conditioner, the indoor unit having at least one outlet, a cross-flow fan, and a stabilizer and a rear guide for guiding an air stream generated by the cross-flow fan, characterized in that the indoor unit comprises a discharge vane at the outlet for controlling a direction of air discharged through the outlet, and a recess formed in the stabilizer facing the outlet for reducing noises caused by an airflow.

Advantageous Effects

According to embodiments, the area ratio of the inlet and outlet of the indoor unit is optimized so that noises can be reduced when air is sucked and discharged through the inlet and outlet.

Furthermore, the noise reducing portion is formed at the rear guide used for guiding an air stream generated by the cross-flow fan so that noises generated at the rear guide can be reduced, and a reverse airflow along the rear guide can be prevented.

In addition, the recess is formed at the outlet to increase the cross sectional area of the outlet so that noises caused by air flowing along the vane can be reduced.

BRIEF DESCRIPTION OF THE DRAWINGS

Embodiments will become more apparent by the accompanying drawings in which:

FIG. 1 is a vertical sectional view illustrating an indoor unit of an air conditioner according to an embodiment;

FIG. 2 is an enlarged view of portion A of FIG. 1;

FIG. 3 is a graph showing a relationship between the noise of the indoor unit and the sizes of an inlet and an outlet of the indoor unit;

FIG. 4 is an enlarged view of portion B of FIGS. 1; and

FIG. 5 is an enlarged view of portion C of FIG. 1.

MODE FOR THE INVENTION

Reference will now be made in detail to the embodiments of the present disclosure, examples of which are illustrated in the accompanying drawings.

FIG. 1 is a vertical sectional view illustrating an indoor unit 100 of an air conditioner according to an embodiment Referring to FIG. 1, the indoor unit 100 includes a main body 110 and a front panel 120. The main body 110 forms the exterior of the indoor unit 100, and the front panel 120 forms the front exterior of the main body 110.

In detail, an upper heat exchanger 300, a lower heat exchanger 310, an upper cross-flow fan 170, and a lower cross-flow fan 160 are installed in the main body 110. Air sucked into the main body 110 exchanges heat with refrigerant streams passing through the upper heat exchanger 300 and the lower heat exchanger 310. The upper cross-flow fan 170 and the lower cross-flow fan 160 draw air into the main body 110.

The front panel 120 can move back and forth with respect to the main body 110.

Therefore, when the indoor unit 100 operates, the front panel 120 moves away from the main body 110 to open an inlet 130. When the indoor unit 100 stops, the front panel 120 moves toward the main body 110 to close the inlet 130.

In this way, the inlet 130 can be selectively opened by the front panel 120. Therefore, the cosmetic appearance of the front side of the indoor unit 100 can be improved.

An upper outlet 150 and a lower outlet 140 are formed on top and bottom sides of the main body 110, respectively.

In detail, the upper outlet 150 is formed by an upper rear guide 190 and an upper stabilizer 191.

The upper rear guide 190 and the upper stabilizer 191 are formed on rear and front sides of the main body 110, respectively.

The upper rear guide 190 includes a curved portion and an extension. The upper stabilizer 191 makes a predetermined angle with the upper rear guide 190.

The upper rear guide 190 and the upper stabilizer 191 determine the direction of air blown by the upper cross-flow fan 170. That is, air blown by the upper cross-flow fan 170 is guided by the upper rear guide 190 and the upper stabilizer 191 such that the air can be discharged to the outside of the indoor unit 100 through the upper outlet 150.

Similarly, the lower outlet 140 is formed by a lower rear guide 180 and a lower stabilizer 181.

The lower rear guide 180 and the lower stabilizer 181 may have the same structures as those of the upper rear guide 190 and the upper stabilizer 191 except that the lower rear guide 180 and the lower stabilizer 181 are formed at a lower portion of the main body 110.

An upper vane 220 and a lower discharge vane 210 are respectively disposed in the upper outlet 150 and the lower outlet 140 for controlling the directions of airflows.

The upper cross-flow fan 170 and the lower cross-flow fan 160 are driven by fan motors (not shown), thereby generating airflows.

The upper cross-flow fan 170 is disposed in front of the upper rear guide 190 and the upper stabilizer 191. The lower cross-flow fan 160 is disposed in front of the lower rear guide 180 and the lower stabilizer 181. The upper cross-flow fan 170 blows air out of the indoor unit 100 through the upper outlet 150, and the lower cross-flow fan 160 blows air out of the indoor unit 100 through the lower outlet 140.

Since the upper cross-flow fan 170 and the lower cross-flow fan 160 are installed in upper and lower portions of the indoor unit 100, air can smoothly flow inside the indoor unit 100 and pass through the upper outlet 150 and the lower outlet 140.

Therefore, the stability of the indoor unit 100 can be improved in terms of airflows by installing two or more cross-flow fans.

The upper heat exchanger 300 is disposed in front of the upper cross-flow fan 170, and the lower heat exchanger 310 is disposed in front of the lower cross-flow fan 160. The upper and lower heat exchangers 300 and 310 make a predetermined angle with a vertical line.

In detail, one end of the upper heat exchanger 300 is fixed to a front upper corner of the main body 110, and the other end of the upper heat exchanger 300 is located at a center portion of the rear side of the main body 110. Similarly, one end of the lower heat exchanger 310 is fixed to a front lower corner of the main body 110, and the other end of the lower heat exchanger 310 is located at the center portion of the rear side of the main body 110.

Air streams directed into the main body 110 through the inlet 130 are divided by the upper and lower heat exchangers 300 and 310. In detail, air streams sucked through the inlet 130 pass through the upper and lower heat exchangers 300 and 310, respectively. Then, the air streams are directed to the upper and lower outlets 150 and 140 by the upper and lower cross-flow fans 170 and 160.

Since the upper and lower heat exchangers 300 and 310 are disposed from the front corners to the center portion of the rear side of the main body 110, air streams can be divided up and down.

Therefore, interference between upper and lower air streams can be minimized, and thus the efficiency of the indoor unit 100 can be improved.

The other end of the upper heat exchanger 300 is disposed on a drain part 200. The drain part 200 is protruded forward from the center portion of the rear side of the main body 110, and the other end of the lower heat exchanger 310 is disposed under the drain part 200.

Waterdrops formed on the upper heat exchanger 300 moves down to the drain part 200.

Another drain part (not shown) can be formed under the lower heat exchanger 310 for collecting waterdrops formed on the lower heat exchanger 310. Alternatively, the lower stabilizer 181 can be used as a drain part for the lower heat exchanger 310.

An operation of the indoor unit 100 will now be described in detail.

When the indoor unit 100 is powered on, the upper and lower cross-flow fans 170 and 160 rotate to generate suction forces, and at the same time, the front panel 120 moves forward to open the inlet 130. Then, air is introduced into the indoor unit 100 through the inlet 130 by the suction forces of the upper and lower cross-flow fans 170 and 160.

Thereafter, the air passes through the upper and lower heat exchangers 300 and 310. While passing through the upper and lower heat exchangers 300 and 310, the air exchanges heat with a refrigerant passing through tubes of the upper and lower heat exchangers 300 and 310.

Thereafter, the air passes through the upper and lower cross-flow fans 170 and 160. An air stream passing through the upper cross-flow fan 170 is guided by the upper rear guide 190 and the upper stabilizer 191 to the upper outlet 150.

Meanwhile, an air stream passing through the lower cross-flow fan 160 is guided by the lower rear guide 180 and the lower stabilizer 181 to the lower outlet 140.

A structure of the indoor unit 100 for reducing noises will now be described.

FIG. 2 is an enlarged view of portion A of FIG. 1, and FIG. 3 is a graph showing a relationship between a noise level of the indoor unit 100 and inlet and the outlet areas of the indoor unit 100.

Referring to FIGS. 2 and 3, the inlet area of the indoor unit 100 can be expressed by the product of the width of the indoor unit 100 and a distance between the front panel 120 and the inlet 130.

When the width of the indoor unit 100 is W, and the distance between the front panel 120 and the inlet 130 is G, the inlet area of the indoor unit 100 can be expressed as follows:

$$A(\text{in})=G\times W$$

Meanwhile, the outlet area of the indoor unit 100 can be expressed by the product of the width (W) of the indoor unit 100 and a minimal distance between the upper rear guide 190 and the upper stabilizer 191.

When the minimal distance between the upper rear guide 190 and the upper stabilizer 191 is L, the outlet area of the indoor unit 100 can be expressed as follows:

$$A(\text{out})=L\times W$$

FIG. 3 shows the noise level of the indoor unit 100 with respect to a ratio of the inlet area A(in) to the outlet area A(out) (hereinafter, referred to as an inlet/outlet area ratio). Referring to FIG. 3, the inlet/outlet area ratio is dimensionless.

When the inlet/outlet area ratio is about 1.5, the noise level of the indoor unit 100 is minimal, and when the inlet/outlet area ratio decreases or increases from 1.5, the noise level of the indoor unit 100 increases.

Particularly, when the inlet/outlet area ratio is greater than 1.8, the airflow of the indoor unit 100 is unstable, and abnormal noises increase.

On the other hand, when the inlet/outlet area ratio is less than 1.2, the noise level of the indoor unit 100 increases significantly although the airflow of the indoor unit 100 is stable.

Therefore, in the current embodiment, to stabilize the airflow of the indoor unit 100 and minimize the noise level of the indoor unit 100, the inlet/outlet area ratio is set to the following range:

$$1.2 \leqq A(\text{in})/A(\text{out}) \leqq 1.8$$

A structure of the indoor unit 100 for reducing noises will now be described.

FIG. 4 is an enlarged view of portion B of FIG. 1.

Referring to FIG. 4, the upper and lower rear guides 190 and 180 have a structure for reducing noises when air is discharged through the upper and lower outlets 150 and 140 by the upper and lower cross-flow fans 170 and 160. A noise reducing portion 250 of the lower rear guide 180 will be now be described as an example of the noise reducing structure.

The noise reducing portion 250 guides an air stream to allow the air to be discharged to the lower outlet 140 through the lower cross-flow fan 160.

Furthermore, the noise reducing portion 250 prevents a reverse airflow when air is discharged by the lower cross-flow fan 160 along the lower rear guide 180 through the lower outlet 140. For this, the noise reducing portion 250 extends an end of the lower rear guide 180.

The noise reducing portion 250 has a channel surface 250*a* recessed from a channel surface 180*a* of the lower rear guide 180 by a predetermined depth (f). The channel surface 250*a* has a radius of curvature Rc.

When the radius of the lower cross-flow fan 160 is R, it is preferable that the noise reducing portion 250 satisfy the following requirements.

First, the depth (f) of the noise reducing portion 250 and the radius (R) of the lower cross-flow fan 160 are related as follows:

$$0.01 \leqq f/2R \leqq 0.03$$

Furthermore, the radius (R) of the lower cross-flow fan 160 is greater than an extension length (S) of the noise reducing portion 250, and the radius (R) and the extension length (S) are related as follows:

$$0.23 \leqq S/2R \leqq 0.37$$

Furthermore, the radius (R) of the lower cross-flow fan 160 is greater than the radius of curvature (Rc) of the noise reducing portion 250, and the radius (R) of the lower cross-flow fan 160 and the radius of curvature (Re) of the noise reducing portion 250 are related as follows:

$$1.3 \leqq Rc/R$$

Another structure of the indoor unit 100 for reducing noises will now be described. In the following description, a structure around the lower outlet 140 will be explained as an example of the noise reducing structure.

FIG. 5 is an enlarged view of portion C of FIG. 1.

Referring to FIG. 5, a lower discharge vane 210 is disposed at the lower outlet 140 to control the direction of air discharged through the lower outlet 140.

The lower discharge vane 210 covers predetermined portions of the lower outlet 140 and the main body 110 to prevent air discharged through the lower outlet 140 from reentering the indoor unit 100 through the inlet 130.

The main body 110 includes a vane mounting recess 112 for receiving a predetermined portion of the lower discharge vane 210.

A recess 114 is formed in the lower stabilizer 181 to reduce noises caused by air discharged through the lower outlet 140.

The cross sectional area of the lower outlet 140 increases owing to the recess 114, such that noises caused by the lower discharge vane 210 can be reduced.

A sub discharge vane 212 is formed at the recess 114. An outer surface of the sub discharge vane 212 is flush with a bottom surface of the recess 114, such that the sub discharge vane 212 can perform the same function as the recess 114.

In detail, the recess 114 has a depth (P). The recess 114 starts from a point spaced apart from a leading end of the lower discharge vane 210 by a length (Q) such that an air stream can receive less resistance at the lower discharge vane 210.

The depth (P) of the recess 114 is smaller than a thickness (T) of the lower discharge vane 210. Preferably, the depth (P) and the thickness (T) are related as follows:

$$0.3 \leqq P/T \leqq 1$$

Furthermore, it is preferable that the length (Q) and the thickness (T) be related as follows:

$$2 \leqq Q/T \leqq 6$$

As described above, according to the embodiments, the inlet/outlet area ratio, the shapes of the rear guides, and the shapes of the outlets are optimally designed. Therefore, the noise level of the indoor unit can be reduced.

INDUSTRIAL APPLICABILITY

According to the embodiments, the structure of the indoor unit, such as the relationship between the inlet and the outlet, the shapes of the rear guides, and the relationship between the outlet and the vane, are optimized to stabilize the airflow of the indoor unit and reduce the noise level of the indoor unit. Therefore, the indoor unit can be applied to various industrial fields.

The invention claimed is:

1. An indoor unit of an air conditioner, comprising:

a cross-flow fan, a stabilizer, a rear guide for guiding an air stream generated by the cross-flow fan, and a noise reducer coupled to a leading end of the rear guide to reduce noise caused by the air stream guided by the cross-flow fan, wherein the noise reducer includes a surface that is recessed relative to a surface of the rear guide, the recessed surface forming an airflow channel of a predetermined depth.

2. The indoor unit according to claim 1, wherein the recessed surface of the noise reducer is integrally formed with said surface of the rear guide.

3. The indoor unit according to claim 1, wherein the recessed surface of the noise reducer has a radius of curvature greater than a radius of the cross-flow fan.

4. The indoor unit according to claim 1, wherein the recessed surface of the noise reducer extends from the leading end of the rear guide by an extension length smaller than a radius of the cross-flow fan.

5. An indoor unit of an air conditioner, comprising:
at least one outlet,
a cross-flow fan,
a stabilizer, and
a rear guide to guide an air stream generated by the cross-flow fan,
wherein the indoor unit further comprises a discharge vane at the outlet for controlling a direction of air discharged through the outlet, and wherein a recess formed in the stabilizer faces the outlet to reduce noise caused by the air stream from the cross-flow fan.

6. The indoor unit according to claim 5, wherein the discharge vane covers a portion of the indoor unit when the outlet is closed using the discharge vane.

7. The indoor unit according to claim 5, further comprising;
a sub discharge vane having an outer surface substantially even with a bottom surface of the recess.

8. The indoor unit according to claim 5, wherein the recess has a depth smaller than a thickness of the discharge vane.

9. The indoor unit according to claim 8, wherein a relationship between the recess and discharge vane is based on a ratio of P/T, where $0.3 \leqq P/T \leqq 1$ and where P corresponds to the depth of the recess and T corresponds to the thickness of the discharge vane.

10. The indoor unit according to claim 8, wherein $2 \leqq Q/T \leqq 6$, where Q corresponds to the length from a leading end of the discharge vane to the point where the recess starts and T corresponds to the thickness of the discharge vane.

11. An indoor unit of an air conditioner, comprising:
a stabilizer,
a cross-flow fan,
a rear guide to guide an air stream generated by the cross-flow fan, and
a noise reducer coupled to the rear guide to reduce noise caused by the air stream from the cross-flow fan, wherein the noise reducer includes a recessed surface that fauns an airflow channel of a predetermined depth.

12. The indoor unit according to claim 11, wherein the noise reducer extends from a leading edge of the rear guide and wherein the recessed surface of the noise reducer is recessed relative to a surface of the rear guide.

13. The indoor unit according to claim 11, wherein a relationship between the noise reducer and cross flow fan is based on a ratio of f/2R, where $0.01 \leqq f/2R \leqq 0.03$ and where f corresponds to the predetermined depth of the airflow channel of the noise reducer and R corresponds to a radius of the cross-flow fan.

14. The indoor unit according to claim 11, wherein a relationship between the noise reducer and cross-flow fan is based on a ratio of S/2R, where $0.23 \leqq S/2R \leqq 0.37$ and where S corresponds to an extension length of the noise reducer from a leading end of the rear guide and R corresponds to a radius of the cross-flow fan.

15. An indoor unit of an air conditioner, comprising:
a stabilizer;
a cross-flow fan;
a rear guide to guide an air stream generated by the cross-flow fan; and
a noise reducer coupled to the rear guide to reduce noise caused by the air stream generated by the cross-flow fan, wherein the noise reducer has a surface that forms an airflow channel having a radius of curvature greater than a radius of the cross-flow fan.

16. The indoor unit of an air conditioner according to claim 15, wherein the surface of the noise reducer that forms the airflow channel is recessed to a predetermined depth relative to a surface of the rear guide forming the airflow channel.

17. The indoor unit of an air conditioner according to claim 15, wherein a relationship between the noise reducer and cross-flow fan is based on a ratio of Rc/R, where 1.3 Rc/R and where Rc corresponds to a radius of curvature of the surface of the noise reducer that forms the airflow channel and R corresponds to a radius of the cross-flow fan.

18. An indoor unit of an air conditioner, comprising:
a stabilizer;
a cross-flow fan;
a rear guide to guide an air stream generated by the cross-flow fan; and
a noise reducer coupled to the rear guide to reduce noise caused by the air stream generated by the cross-flow fan, wherein the noise reducer has a surface that extends from the rear guide by an extension length and wherein the extension length is less than a radius of the cross-flow fan.

19. The indoor unit according to claim 18, wherein the surface of the noise reducer is recessed to form an airflow channel.

* * * * *